US012304708B2

(12) United States Patent
Buck

(10) Patent No.: US 12,304,708 B2
(45) Date of Patent: May 20, 2025

(54) CHILD RESISTANT ENCLOSURE

(71) Applicant: Jeremiah Buck, Wheat Ridge, CO (US)

(72) Inventor: Jeremiah Buck, Wheat Ridge, CO (US)

( * ) Notice: Subject to any disclaimer, the term of this patent is extended or adjusted under 35 U.S.C. 154(b) by 82 days.

(21) Appl. No.: 18/308,826

(22) Filed: Apr. 28, 2023

(65) Prior Publication Data

US 2024/0359883 A1 Oct. 31, 2024

(51) Int. Cl.

| | |
|---|---|
| ***B65D 50/04*** | (2006.01) |
| ***B65D 43/16*** | (2006.01) |
| ***B65D 43/22*** | (2006.01) |

(52) U.S. Cl.

CPC ..... *B65D 50/046* (2013.01); *B65D 43/162* (2013.01); *B65D 43/22* (2013.01); *B65D 2215/02* (2013.01)

(58) Field of Classification Search

CPC .... B65D 50/046; B65D 43/162; B65D 43/22; B65D 2215/02

USPC ..... 220/833, 23.87; 206/463

See application file for complete search history.

(56) References Cited

U.S. PATENT DOCUMENTS

| | | | | |
|---|---|---|---|---|
| 7,694,824 | B2 * | 4/2010 | Bae | A45D 33/006 206/530 |
| 10,850,897 | B2 | 12/2020 | Charm | |
| 2012/0325714 | A1 * | 12/2012 | Hansen | B65D 73/0092 220/4.23 |
| 2017/0137184 | A1 | 5/2017 | Burek et al. | |
| 2021/0221576 | A1 * | 7/2021 | Dornes | B65D 50/045 |

* cited by examiner

*Primary Examiner* — J. Gregory Pickett
*Assistant Examiner* — Sanjidul Islam
(74) *Attorney, Agent, or Firm* — Harpman & Harpman

(57) ABSTRACT

A child resistant storage case having a base with an offset hinge lid forming an interior storage area therein. A deformable sealing and lid retainment insert has oppositely disposed dual latch elements registerably retaining the lid in closed sealed position. A pair of independent release buttons extending through respective base end walls engaging respective yielding end portions of said sealing and lid retainment insert under simultaneous inward pressure releasing the lid for storage area access.

7 Claims, 6 Drawing Sheets

CHILD RESISTANT ENCLOSURE

BACKGROUND OF THE INVENTION

1. Technical Field

This invention relates to child resistant containers that typically require some sort of dual simultaneous action to open, specifically to a selected sealed container that maintain an air and moisture tight seal between the closure lid and the contents interior base.

2. Description of Prior Art

Prior art child resistant containers have been developed having a variety of different latch release mechanism, see for example U.S. Pat. No. 10,850,897, U.S. Publications 2017/0137184 and 2021/0221576.

In U.S. Pat. No. 10,850,897 a container with a child resistant lid is disclosed having a base and a lid with a pair of latch engagement elements extending from the lid and a cutter assembly for product to be stored within.

U.S. Publication 2017/0137184 discloses a child resistant storage case having a main latch assembly with oppositely disposed side release latches that directly engage the lid when closed. Both side release latches must be engaged simultaneously to release and open the lid.

In U.S. Publication 2021/0221576 a child proof container configuration is claimed in multiple embodiments formed with an insert that provides dual lid engagement release latches. Each latch has a lid locking tab with an integral engagement button on a flexible insert portion for direct user engagement and independent actuation. A center lid latch is also provided which requires a third activation button release mechanism.

SUMMARY OF THE INVENTION

A child resistant storage container that provides an airtight sealed interior with an integrated latch lid engagement and deformable respective sealing latch sidewalls for lid release upon simultaneous deflection by respective independent engagement elements.

DETAILED DESCRIPTION OF THE INVENTION

Figure 1:
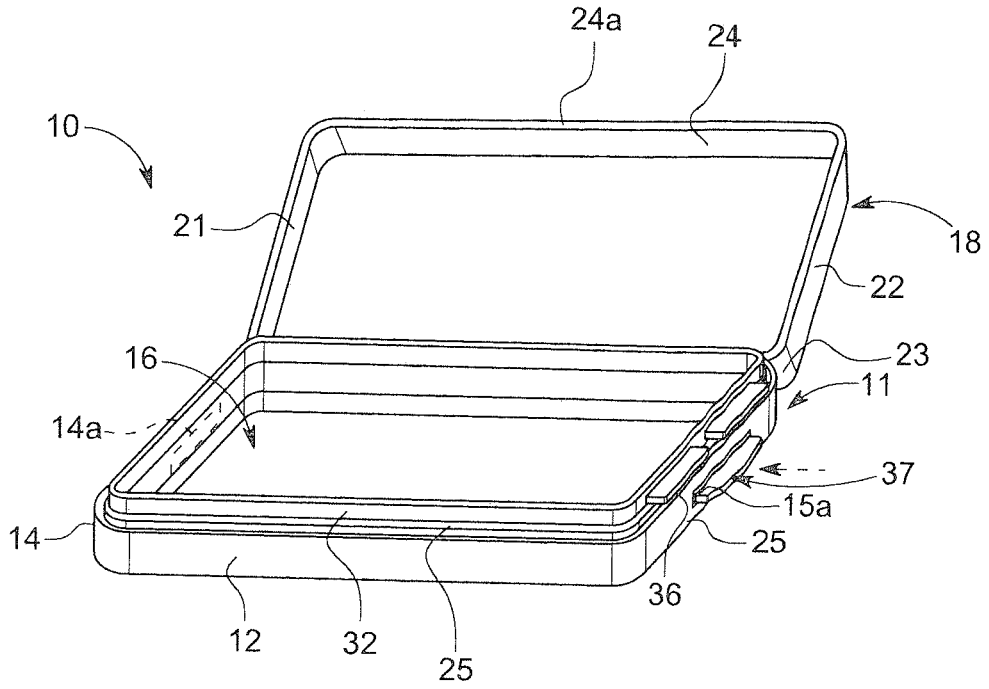
FIG. 1 is a perspective view of the child resistant container of the invention in open access position.
Figure 2:
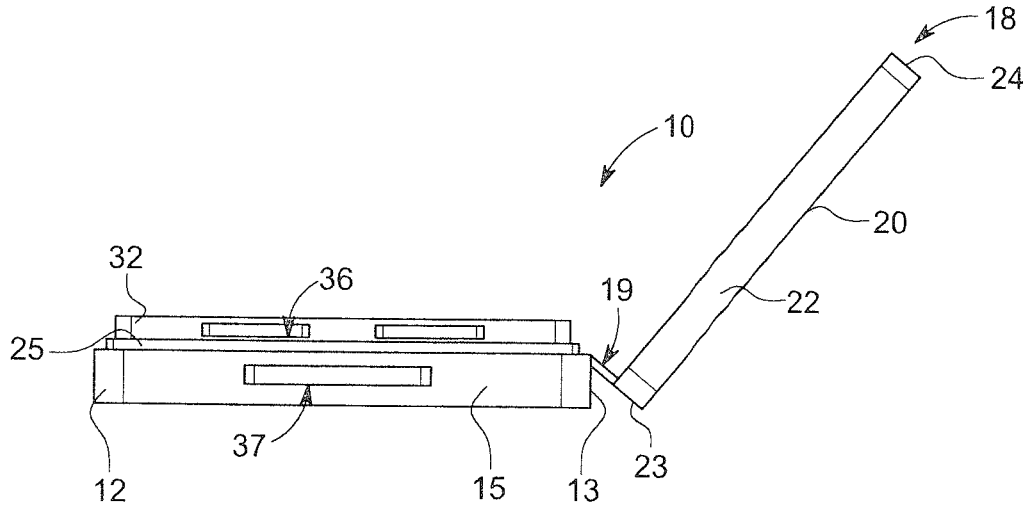
FIG. 2 is an end elevational view thereof.
Figure 3:
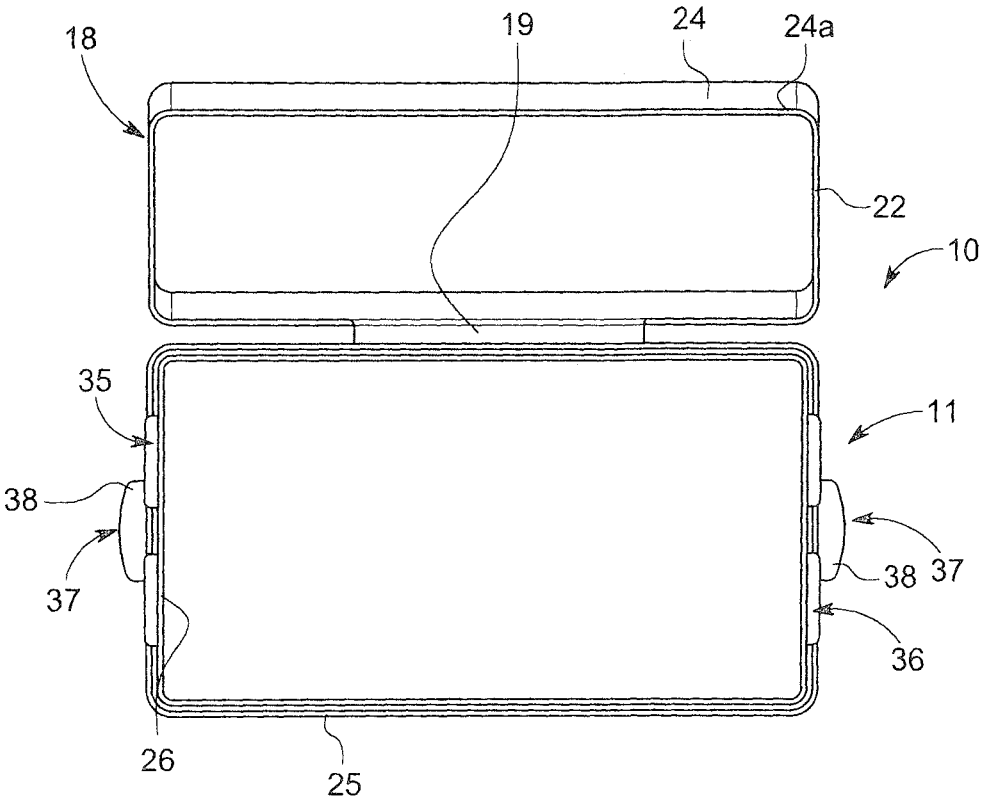
FIG. 3 is a top plan view thereof.

Referring now to FIGS. 1-3 of the drawings, a child resistant storage container 10 of the invention can be seen in an open accessed position. The container 10 has a base portion 11 with spaced parallel upstanding front and back walls 12 and 13 and interconnecting upstanding parallel end walls 14 and 15. An integral flat interconnecting bottom 16 there between defines a product receiving area 17 there within.

A closure lid 18 is pivotally secured to the back wall 12 by an extending hinge assembly 19. The closure lid 18 has respective top 20 with depending sidewalls 21 and 22 and integral interconnecting front and back lid walls 23 and 24.

The free edges of the respective lid walls have a rolled perimeter edge 24A in this application formation defining a latch engagement and retainment surface as will be disclosed and described in greater detail hereinafter.

Referring now to the base enclosure 11, it will be seen as having an upstanding offset continuous lip 25 formed around the free edges of the base enclosures respective front and back 12 and 13 walls and end walls 14 and 15.

A pair of oppositely disposed elongated latch activation access openings are formed at 14A and 15A within the respective end walls 14 and 15 to provide access to dual latch release assemblies which will be described in greater detail hereinafter.

Figure 7:
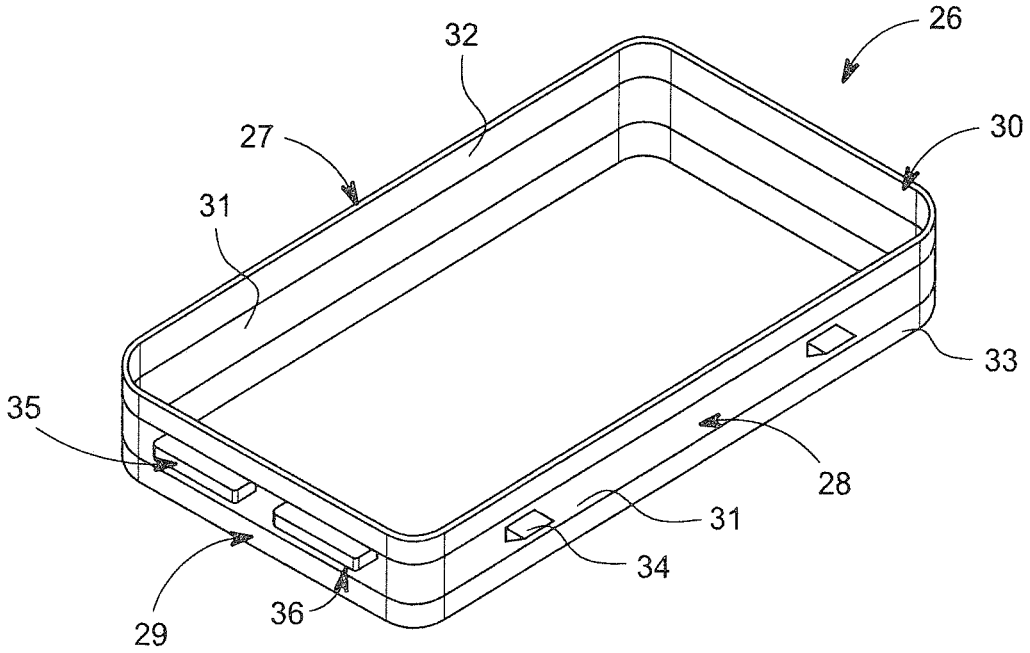
FIG. 7 is a perspective view of the sealing insert.

Referring now to FIGS. 1, 2 and 7 of the drawings, a deformable lid retaining and sealing insert 26 can be seen having an overall rectangular configuration with spaced parallel sidewalls 27 and 28 and interconnecting integral respective end walls 29 and 30.

The sealing insert 26 has a molded flexible synthetic resin plastic core 31 with respective upper and lower fused sealing material edges 32 and 33 there about. The sealing edges 32 and 33 are molded from a highly pliable rubberized resin that forms integrated continuous upper and lower gaskets about the core 31.

Pairs of insert retaining tabs 34 extend in spaced parallel longitudinal relation to one another from the respective sidewalls 27 and 28. Correspondingly, a pair of insert latch elements 35 and 36 extend and aligned in adjacent relation to one another from respective core end walls 29 and 30. The respective oppositely disposed latch element pairs 35 and 36 are aligned when inserted so as to be positioned as to rest on the corresponding respective end wall upstanding offset lip 25 as seen best in FIGS. 1 and 2 of the drawings.

Referring now to FIGS. 6, 8-11 of the drawings, activation latch release button 37 can be seen having a user engagement portion 38 extending from an elongated support body 39 with a retainment element 40 extending in oppositely disposed spaced relation thereto. A raised insert engagement bar 40A extends from the retainment element 40. This orientation will become apparent when viewed in assembly as discussed hereinafter.

Figure 8:
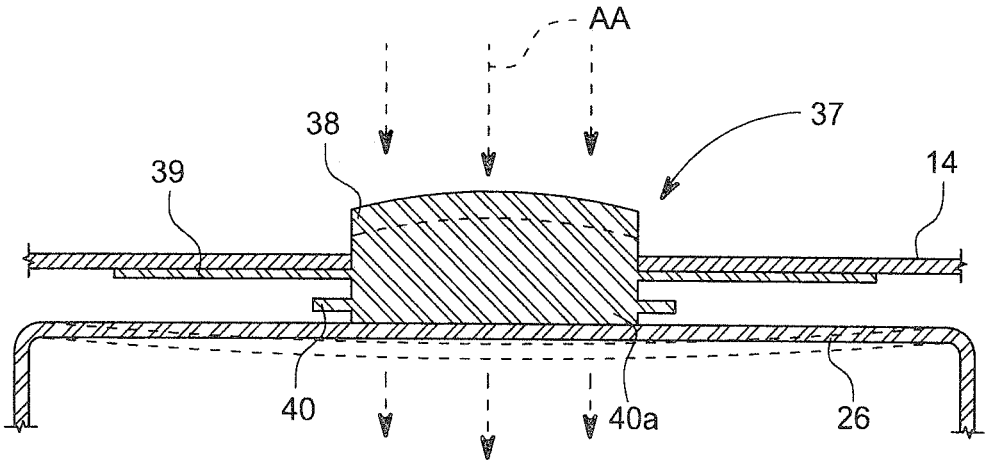
FIG. 8 is an enlarged top plan partial sectional view of the latch release button.
Figure 9:
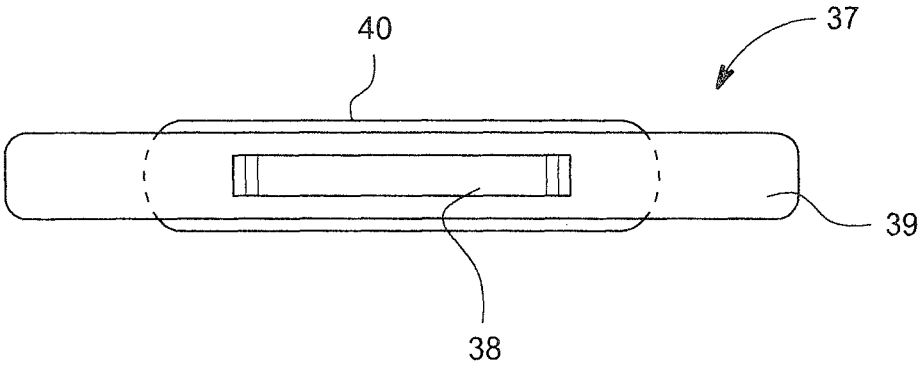
FIG. 9 is an enlarged front elevational view of the latch release button.
Figure 10:
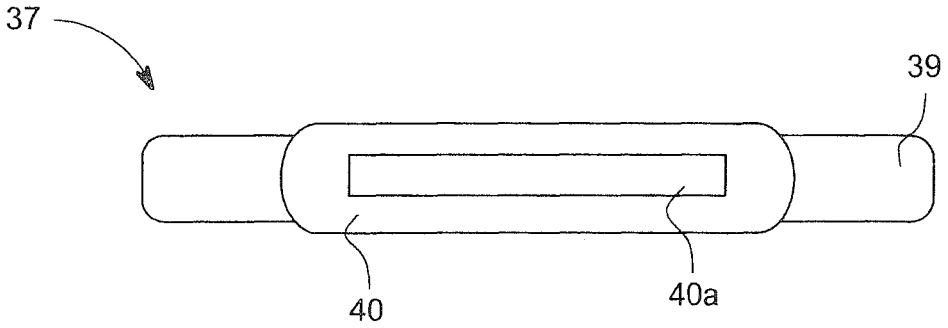
FIG. 10 is an enlarged rear elevational view thereof.
Figure 11:
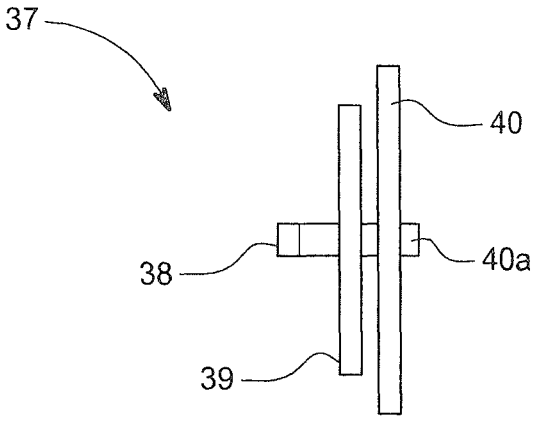
FIG. 11 is an enlarged end elevational view thereof.
Figure 12:
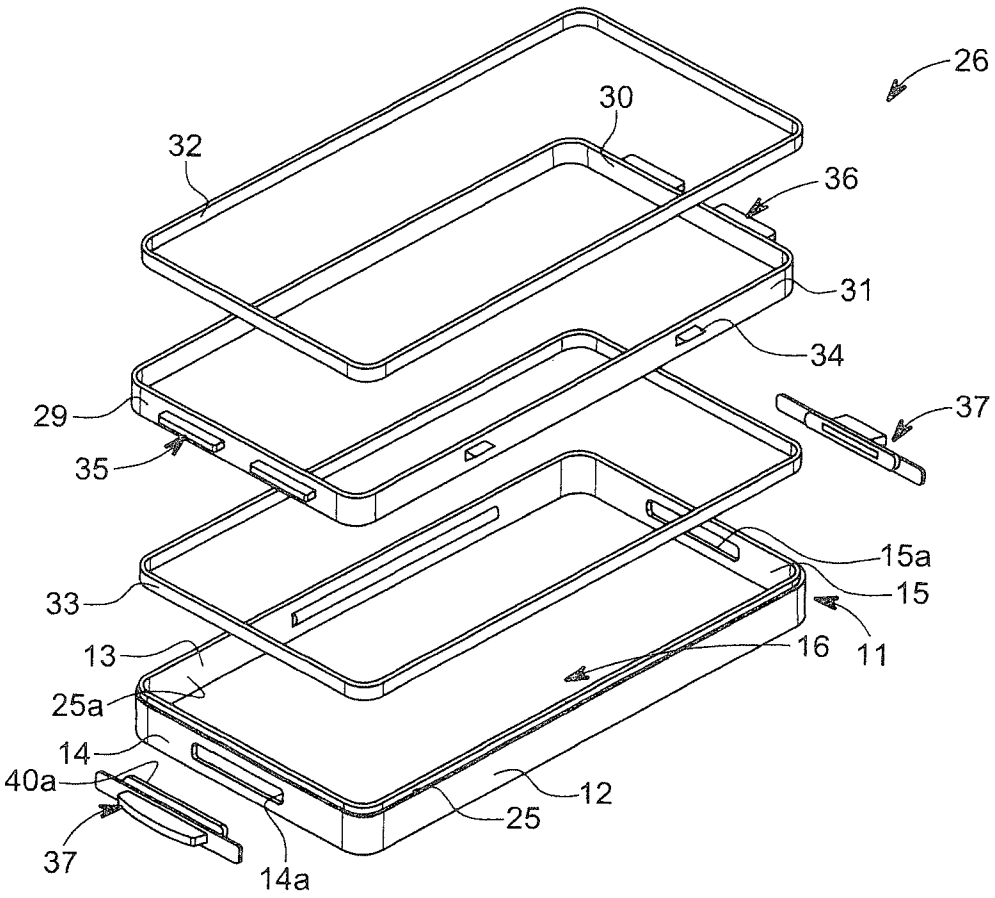
FIG. 12 is an exploded perspective view of the container base, sealing latch insert and latch release button.

Referring now to FIGS. 1 and 12 of the drawings, the assembly of the child resistant storage container 10 can be seen wherein the activation latch release buttons 37 are initially inserted into the respective latch activation access openings 14A and 15A. The sealing insert 26 is then positioned in the base 11 by initial transverse deflection of the respective support walls 27 and 28 so that their corresponding space retaining tab pairs 34 will fit below and engage the inner surface 25A of the offset continuous formed lip 25 thereby retaining the sealing insert 26 there within. Correspondingly, the activation latch release buttons 37 are held in place against the respective sealing insert 26 thereby providing for direct contact with the flexible end walls 29 and 30 by applied pressure thereto indicated by broken activation arrow lines AA as seen in FIGS. 1, 4 and 8 of the drawings.

Figure 4:
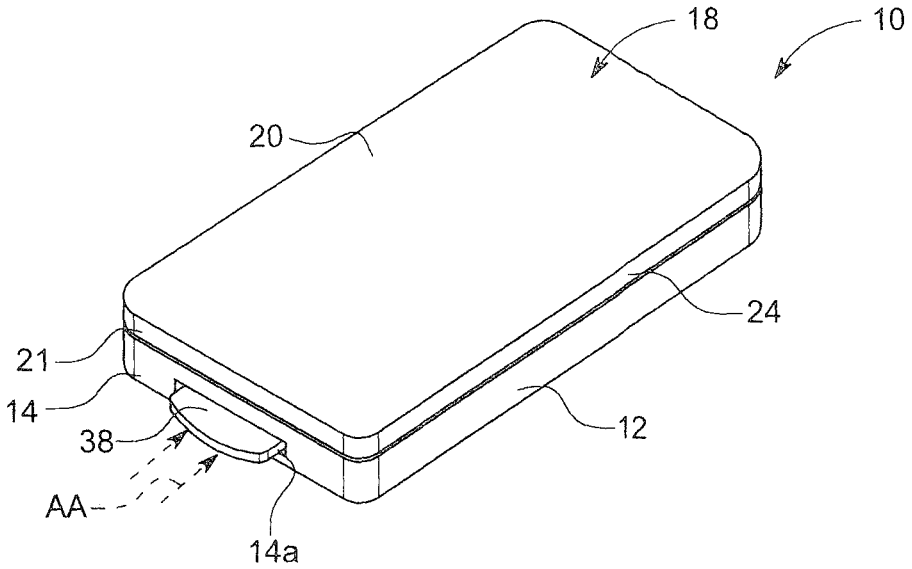
FIG. 4 is a perspective view of a child resistant container in closed locked position.
Figure 5:
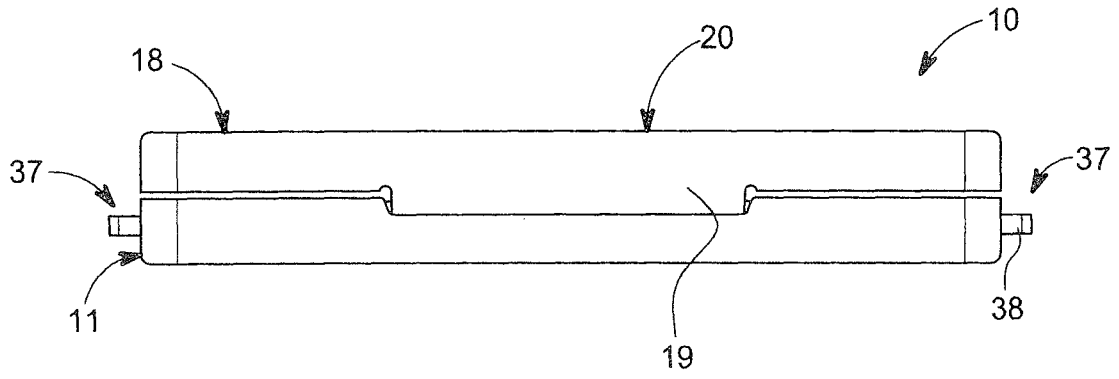
FIG. 5 is a rear elevational view thereof.
Figure 6:
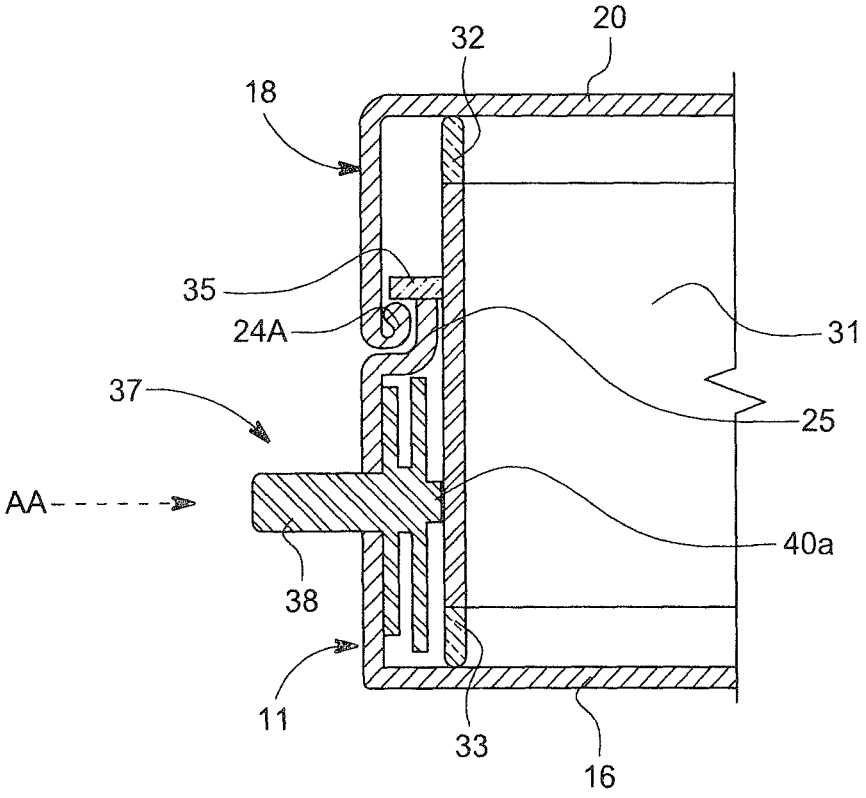
FIG. 6 is an enlarged partial sectional view of the sealing and release latch.

It will be evident from the above description that once the storage container 10 is closed, best seen in FIG. 4 of the drawings, in a lid locked sealing position that to open, simultaneous pressure must be applied to the respective oppositely disposed activation buttons 37 indicated by the broken force arrow lines AA deflecting the sealing insert 26 respective end walls 29 and 30 and thereby moving the latch lid engagement tab pairs 34 and 35.

This action will release the hinged close lid 18 to a lid reloaded position which then can be opened for access to the contents within. The ability of the sealing insert 26 to act as both a sealing gasket between the base bottom 16 and interior surface of the lid 18 when closed and as a dual latch element to retain the lid 18 in closed position is unique and provides a compound combination that assures an airtight seal and reliant resilient locking elements.

It will also be noted that the offset hinge assembly 19 which pivotally attached to the base enclosure 11, back wall 12 at 19A provides for a self-supporting open lid position indicated at 40 in FIGS. 1-4 of the drawings.

It will thus be seen that a new and novel self-sealing child resistant storage container 10 has been illustrated and described and that various changes and modifications may be made therein without departing from the spirit of the invention.

Therefore, I claim:

1. A child resistant sealing storage container comprises, a base, defining an internal storage space with peripheral front, back and end walls, a hinged lid extending from said base, said hinged lid having depending perimeter walls, a selective deformable lid retaining and sealing insert there within, said lid retaining and sealing insert comprising, continuous dual component sidewalls and end walls defining a flexible core, upper and lower sealing edge gaskets molded to said flexible core, insert retainment tabs extending from said respective core sidewalls, pairs of latch elements extending from said respective core end walls for registration with said hinged lid, dual latch release mechanisms extending through oppositely aligned apertures in said base end walls configured for registration and selective deflection of said respective flexible core end walls and said insert latch elements to release said hinged lid.

2. The child resistant sealing storage container set forth in claim 1 wherein said dual latch release mechanism is configured to be pressed simultaneously for lid release from said base comprises, latch release buttons having an engagement portion, an elongated retainment portion, and an insert engagement portion band.

3. The child resistant sealing storage container set forth in claim 1 wherein said hinge lid further comprises, a rolled edge on said depending perimeter walls selectively engaged by said respective insert latch elements when lid is in closed position.

4. The child resistant sealing and storage container set forth in claim 1 wherein said insert retainment tabs are in spaced longitudinal aligned position to one another configured to engage and offset lip formed on the free edges of said respective perimeter base walls.

5. The child resistant sealing and storage container set forth in claim 1 wherein a hinge assembly on one of depending lid perimeter walls offsets said hinged lid from said base enabling the hinged lid to pivot between a self-supporting open position to a closed base sealing engagement position.

6. The child resistant sealing and storage container set forth in claim 1 wherein said latch elements are movable from a first lid locked sealing lock position to a second lid release position by simultaneous translateral deflection by said respective activation release mechanisms.

7. The child resistant sealing and storage container set forth in claim 1 wherein said sealing edge gaskets on said retaining and sealing insert enable compressible engagement between said lid and a base bottom by a locking registerable engagement of said lid to said latch elements.

* * * * *